United States Patent [19]

Hoehing et al.

[11] 4,140,472

[45] Feb. 20, 1979

[54] METHOD AND APPARATUS TO REPLACE NATURAL GAS WITH VAPORIZED FUEL OIL IN A NATURAL GAS BURNER

[75] Inventors: William W. Hoehing, Houston, Tex.; Edward R. Johnson, Hopewell, Va.

[73] Assignee: Allied Chemical Corporation, Morristown, N.J.

[21] Appl. No.: 758,969

[22] Filed: Jan. 13, 1977

[51] Int. Cl.[2] ..... F23D 11/44; F23N 1/00

[52] U.S. Cl. ..... 431/11; 431/12; 431/37

[58] Field of Search ..... 431/11, 12, 5, 4, 211, 431/208, 89, 36, 37, 41; 208/361, 131; 203/88, 347; 236/14, 15 E, 15 R; 252/373

[56] References Cited

U.S. PATENT DOCUMENTS

| | | | |
|---|---|---|---|
| 1,747,375 | 2/1930 | Mallery | 431/4 |
| 1,761,537 | 6/1930 | Ravenor | 431/11 |
| 1,832,280 | 11/1931 | Couttas | 431/4 |
| 1,959,031 | 5/1934 | Masters | 431/11 |
| 2,866,602 | 12/1958 | Dailey, Jr. et al. | 431/12 |
| 3,291,191 | 12/1966 | Stoops | 431/11 |
| 3,314,879 | 4/1967 | Lacy et al. | 208/361 |
| 3,384,576 | 5/1968 | Greco | 208/361 |
| 3,444,052 | 5/1969 | Bracken et al. | 203/88 X |
| 3,561,895 | 2/1971 | Michelson | 431/89 X |
| 3,614,282 | 10/1971 | Gabor | 431/11 X |
| 3,711,457 | 1/1973 | Ayers | 203/88 X |
| 3,734,675 | 5/1973 | Osburn | 431/12 |
| 3,885,905 | 5/1975 | Feng | 431/11 |
| 4,025,282 | 5/1977 | Reed et al. | 431/11 |

*Primary Examiner*—Edward G. Favors
*Assistant Examiner*—Larry Jones
*Attorney, Agent, or Firm*—Michael S. Jarosz

[57] ABSTRACT

A method to replace natural gas with vaporized fuel oil is disclosed. The method, in general, is mixing the fuel oil with a diluent, such as steam, then vaporizing a portion of the mixed fuel oil in a vaporizer, then separating the liquid from the vapor, then maintaining the vapor at from about 50° to 300° F. above the dew point of the mixed vapor and diluent and preferably maintaining the pressure of the mixed vapor and diluent at about 75 to 150 psig, above the pressure downstream of a valve controlling flow of the vapor mixed with diluent, and burning the vapor in a burner designed for natural gas without major modifications to the burner. The temperature and pressure can be maintained by heat from the vaporizer or by adding heat from a superheater.

3 Claims, 4 Drawing Figures

METHOD AND APPARATUS TO REPLACE NATURAL GAS WITH VAPORIZED FUEL OIL IN A NATURAL GAS BURNER

BACKGROUND OF THE INVENTION

This invention relates to a method to modify and vaporize liquid hydrocarbons so that they may be burned in a conventional gas burner, more particularly, the method is to mix fuel oil with diluent, such as steam, partially vaporize the fuel oil, separate out liquid, superheat the vapor and burn it in a burner designed for natural gas without major modifications to the burner.

This invention is an improvement on the invention in copending application Ser. No. 758,586, of even date, which in turn is a continuation-part application of application Ser. No. 549,641, filed Feb. 13, 1975, now abandoned, hereby incorporated by reference.

The general concept of mixing oil and steam to vaporize, and subsequently superheating the mixture, the burning it, is very old as shown in U.S. Pat. No. Re. 10,699 (1886); U.S. Pat. No. 1,719,397 (1929); and U.S. Pat. No. 1,971,846 (1934).

Also, the general concept of separating liquid from vapor in the effluent of a vaporizer with recirculation of a portion of a separator bottoms to the vaporizer, and with another portion of the separator bottoms drawn off, is old as shown in U.S. Pat. No. 1,842,320 (1932) and U.S. Pat. No. 2,799,628 (1957).

The concept of mixing a diluent gas into a vaporized oil is also disclosed in the prior art such as in U.S. Pat. No. 3,561,895 and in U.S. Pat. No. 1,958,671.

Flashing of liquid (not vapor) oil is known, see U.S. Pat. No. 2,067,940.

It is disclosed in many patents such as U.S. Pat. No. 3,291,191 and U.S. Pat. No. 3,885,904, mixing oil vapor with air and/or products of oil combustion prior to the burner in order to use normally liquid fuel in conventional gas burners. This explosive mixture is not part of the inventive concept of this patent application.

In U.S. Pat. No. 3,938,934 the concept of warming the air for combustion with warm water to be cooled by means for evaporative cooling such as a cooling tower is disclosed.

In U.S. Pat. No. 3,049,168 the disclosure is limited to simultaneous burning of two fuels from two separate burners, one for each fuel.

U.S. Pat. No. 3,561,895 discloses feeding fuels of different molecular weights to a burner having constant air flow. This patent discloses the steps of determining the variations and density of the second fuel and adjusting the temperature of the second fuel to equalize the density of the second fuel with the first so as to maintain constant air flow at the burner even through fuels are changed. U.S. Pat. No. 3,291,191 discloses a method of operating a gas burner in interruptable service. The method is (a) terminating the flow of gas, (b) supplying a light petroleum hydrocarbon, (c) mixing the hydrocarbon with air and burning the hydrocarbon. The light hydrocarbon must have an end boiling point not exceeding about 450° F. U.S. Pat. No. 3,285,320 has a disclosure limited to a control system which varies the flow of the fuel in accordance with the specific gravity or varies the flow with the specific gravity plus the Btu value.

The prior art also teaches the use of steam to atomize oil such as in U.S. Pat. No. 1,766,243 or U.S. Pat. No. 132,440 (1872). The latter patent also superheats the atomized or vaporized oil. For purposes of this patent application, vaporization shall mean changing the liquid fuel oil to a vapor, not merely physically breaking it up into droplets or a fog such as disclosed in the "atomizing" prior art.

The following U.S. Pat. Nos. are of some interest:

| | | |
|---|---|---|
| 3,897,194 | 3,614,282 | 2,070,209 |
| 3,885,904 | 3,463,599 | 1,987,400 |
| 3,850,569 | 3,236,281 | 1,843,757 |
| 3,876,363 | 3,159,345 | 1,337,144 |
| 3,808,795 | 3,107,719 | 1,158,687 |
| 3,749,318 | 2,975,594 | 1,466,250 |
| 3,672,808 | 2,972,058 | |
| 3,649,230 | 2,866,602 | |

SUMMARY OF THE INVENTION

It is essential that vaporized fuel oil mixtures be supplied to the burner fuel headers at a controlled pressure and temperature. Both pressure and temperature must be maintained within specific limits to insure optimum burner flame characteristics and to permit regulation of the fuel flow or heat input to the furnace or heater being fired.

Also, the vaporized fuel mixtures must be superheated sufficiently so that no hydrocarbon is condensed in the fuel header. Liquids cause incomplete combustion, sparking and yellow streaks in the flame.

These problems of poor burner flame characteristics are overcome by the operating parameters of this invention.

One aspect of this invention is a method to replace natural gas with vaporized fuel oil for burning in a natural gas burner without major modifications to the burner. The method comprises mixing fuel oil with a gaseous diluent, then vaporizing a portion of the fuel oil in the mixture of fuel oil and diluent in a vaporizer, then separating the vapor portion from the liquid portion of the partially vaporized fuel oil as overhead effluent vapor in the separator and maintaining this vapor at a high temperature and pressure with heat from the vaporizer, while controlling the temperature, pressure and/or flow rates of the mixing, vaporizing and separating.

In this mode of operation the mixture of diluted vaporized fuel oil is maintained at high temperature and pressure by the heat of the vaporizer and "flashed" across the valve controlling the flow of the separator overhead vapor to a lower temperature and pressure before it is burned.

In this mode of operation it is preferable to maintain the vaporized fuel and diluent exiting the vaporizer at a temperature of between about 50° to 300° F. above the dewpoint of the mixture and maintaining the separation and vaporization at a pressure of between about 75–150 psig, above the pressure downstream of the valve controlling the separator overhead. More preferably, this pressure is 100–150 psig. This mixture is then burned in the burner.

In another mode, the method uses superheating of the overhead effluent from the separator. This method is also to replace natural gas with vaporized fuel oil for burning in at least one natural gas burner, without major modifications to the burner. This method comprises mixing fuel oil with a gaseous diluent, then vaporizing a portion of the fuel oil in the mixture of fuel oil and diluent in a vaporizer, then separating the vapor portion from the liquid portion of the partially vaporized fuel oil as overhead effluent in a separator, then superheating the overhead effluent from the separator, while controlling the temperature, pressure and/or flow rates of the mixing, vaporizing, separating and superheating.

Preferably, the superheating is carried out to heat the overhead effluent from the separator to a temperature of between about 50° to 300° F. of the dewpoint above the overhead effluent from the superheater. This overhead effluent is the mixture of diluted fuel oil vapor which is then burned in the burner. Even more preferably for both above modes, the temperature is between about 100° to 275° F. above the dewpoint. Preferably, the superheating takes place at a pressure of between about 15 to 85 psig. Also, the pressure downstream of the valve automatically controlling the flow of the superheater overhead is preferably steady at a value of between about 5 and 80 psig, and more preferably 2 to 60 psig.

It is preferred that the valve automatically controlling the flow of the superheater overhead is controlled by a flow recorder-controller set to sense and automatically control the flow.

In a preferred embodiment the diluent is also superheated before being added to the fuel oil. Superheating is preferably accomplished by heat exchange with waste heat from the vaporizer, and even more preferably, the vaporizing is accomplished by burning a fuel and heat exchange is accomplished by passing hot combustion gases from the burning to heat the vaporizer across the heat exchanger. This heat exchanger can be located as a coil in the vaporizer exhaust stack. Preferably, the heat exchanger is a coil disposed within or around a cylinder in the exhaust stack of the vaporizer and the cylinder has an internal damper automatically controlling the temperature of the superheated diluent by sensing its temperature with a temperature controller which automatically opens and closes the damper.

The preferable diluent is selected from the group consisting of steam, natural gas, purge gas, low Btu fuel gas, and mixtures thereof, and most preferred is steam.

Also, the combustion air supplied to the natural gas burner is preferably preheated in both modes of operation. This preheating can be accomplished by heat exchange with waste heat, preferably from combustion gases from a burned fuel. Even more preferably, the combustion gases are flue gases from the former natural gas burner.

It is preferable that at least a portion of the separator bottoms is drawn off (blowdown) to storage in order to remove nonvaporized accumulated metals and sulfur impurities from the fuel oil being fed to the vaporizer. This is true for both of the above modes of operation. Also, a preferable embodiment is wherein in addition to the separator bottoms being drawn off to storage another portion of the separator bottoms is recycled to pass through the vaporizer. Since the fuel oil is only partially vaporized, either blowdown or recirculation or both is essential in order to accommodate the liquid accumulating in the separator.

In a broad aspect, the apparatus of this invention is an apparatus to replace natural gas with vaporized fuel oil, whereby the fuel oil is mixed with a gaseous diluent and partially vaporized to burn in at least one natural gas burner without major modifications to the burner. The apparatus comprises an oil vaporizer, a gas liquid separator, a source of fuel oil under pressure, a source of diluent under pressure, a source of heat for the vaporizer, and a control system to control the temperature, pressure and/or flow rates into and out of the vaporizer and the separator. The fuel oil and diluent are admixed and introduced into the vaporizer, the effluent from the vaporizer is introduced to the separator, and the overhead effluent to the separator is burned in the former natural gas burner.

In another aspect using a superheater, the apparatus of this invention is an apparatus to replace natural gas with vaporized fuel oil, whereby the fuel oil is mixed with a gaseous diluent and partially vaporized to burn in at least one natural gas burner without major modifications to the burner. The apparatus comprises a source of fuel oil under pressure, a source of diluent under pressure, an oil vaporizer, a gas-liquid separator, a vaporizer effluent superheater, a source of heat for the vaporizer, a source of heat for the superheater and a control system to control the temperature, pressure and/or flow rates into and out of the vaporizer, separator and superheater. The fuel oil and diluent are admixed and introduced into the vaporizer with the effluent from the vaporizer being introduced into the separator, the overhead effluent vapor from the separator being introduced into the superheater and the effluent from the superheater being burned in the burner.

In another preferred embodiment the apparatus also comprises a diluent superheater. The diluents are preferably selected from the group consisting of steam, natural gas, purge gas, low Btu fuel gas, and mixtures thereof, and most preferably, steam.

It is preferred to preheat the combustion air to the natural gas burner with a preheater. This is true with both of the above embodiments.

The critical temperature and pressure in the vaporizer, separator, and/or superheater and fuel header to the burners is set out in the following aspects of this invention. In a broad aspect, this invention is a method to replace natural gas with vaporized fuel oil for burning in at least one natural gas burner without major modifications to the burner. The method comprises mixing fuel oil with a gaseous diluent, then vaporizing a portion of the fuel oil in the mixture of fuel oil and diluent in a vaporizer, then separating the vapor portion from the liquid portion of the partially vaporized fuel oil as overhead effluent in a separator, with the overhead effluent being maintained at about 50° to 300° F. above the dewpoint of the mixed vapor and diluent, and being maintained at about 75 to 150 psig above the pressure downstream of the valve controlling the flow of the overhead effluent to the burner, i.e., the fuel header to the burners while controlling the temperature, pressure and/or flow rates of the mixing, vaporizing and separating. Preferably, the temperature is maintained at about 100°–275° F. above the dewpoint of the mixture and the pressure is about 100–150 psig above the pressure downstream of the valve.

In the final aspect, this invention is a method to replace natural gas with vaporized fuel oil for burning in at least one natural gas burner without major modifications to the burner. This method comprises mixing fuel oil with a gaseous diluent, then vaporizing a portion of the fuel oil in a mixture of fuel oil and diluent in a vaporizer, then separating the vapor portion from the liquid portion of the partially vaporized fuel oil as overhead effluent in a separator, then superheating the overhead effluent from the separator, and maintaining the temperature of the superheater effluent at between about 50°–300° F. above the dewpoint of the superheater effluent, while controlling the temperature, pressure, and/or flow rates of the mixing, vaporizing, separating and superheating. The preferred temperature is about 100°-275° F. above the dewpoint of the mixture. The preferred pressure of the superheater effluent is from about 2 to about 60 psig above the pressure downstream of the valve controlling the flow of the superheater effluent to the burner.

The preferred pressure in the fuel header to the burners, i.e., downstream of the valve controlling flow of the superheater effluent or the separator effluent is between about 10 to 70 psig.

By properly controlling the temperature, pressure, and flow rates with and in the apparatus of this invention, fuel oil may be diluted, vaporized, and burned in a natural gas burner, without major modifications to the burner, to achieve a clear, blue, uniform, flame, similar in characteristics to a natural gas flame. The actual temperature, pressure and flow conditions to achieve a good flame will necessarily vary with the heat load required, the type of burner used, the type of furnace being fired, i.e., downdraft, radiant wall, etc., the particular characteristics of the fuel and diluent and many other variables.

DESCRIPTION OF THE PREFERRED EMBODIMENTS

Like numbers reference like elements in all the drawings.

Figure 1:
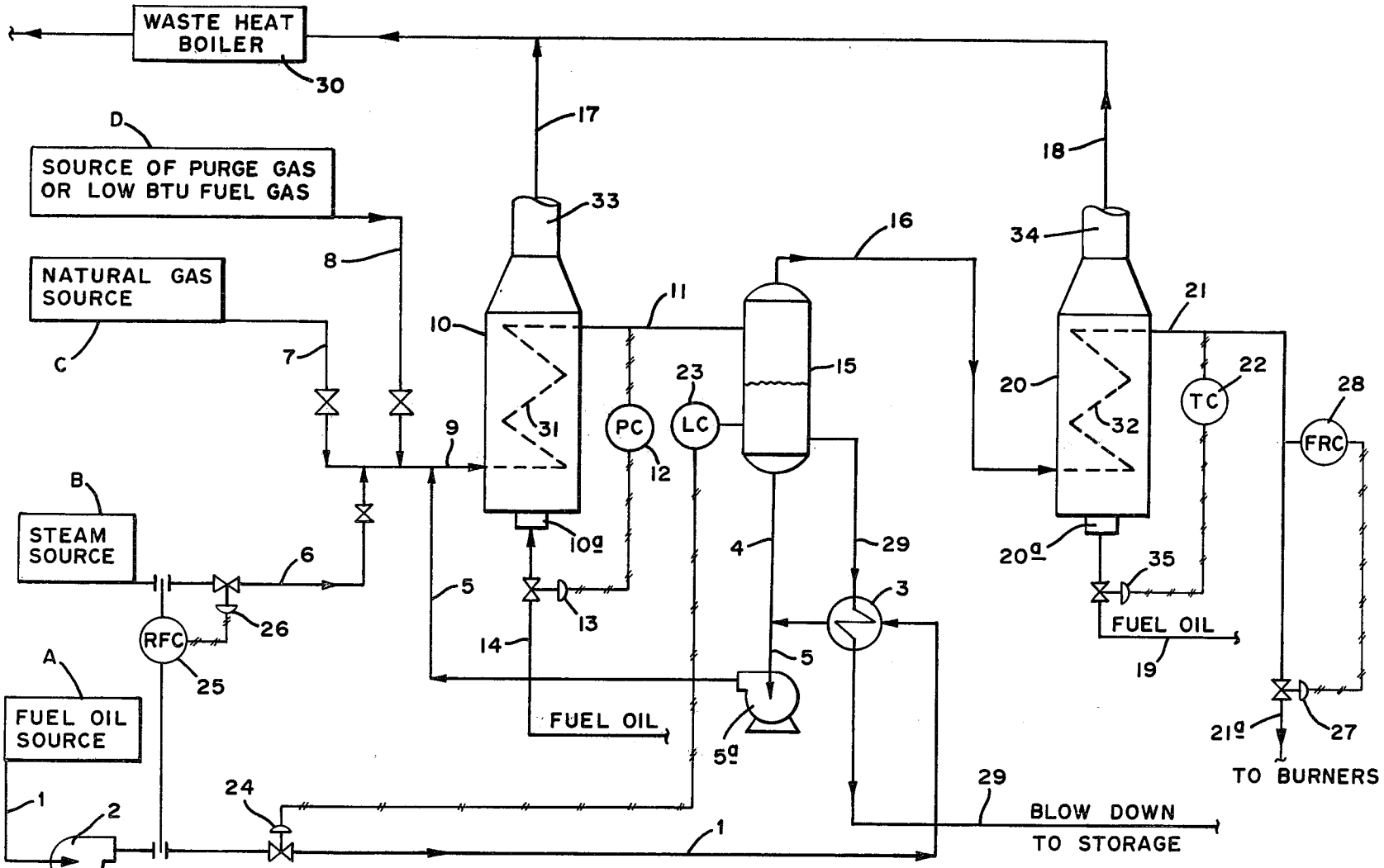
FIG. 1 is a schematic showing the apparatus of this invention and illustrating the method.

In FIG. 1, the main elements of the schematic of the apparatus and flow sheet are a source of fuel oil A, a steam source B, natural gas source C, source of purge gas or low Btu fuel gas D, the vaporizer 10, separator 15, and superheater 20. Fuel oil from fuel oil source A flows through line 1 to pump 2 and further through line 1 to be heated by heat exchanger 3, and combined with separator 15 bottoms through line 4, combined fresh fuel oil and separator bottoms then flow through line 5 to be pumped by pump 5a through line 5 to vaporizer feed header 9. Also, steam from a supply of steam under pressure from steam source B flows through line 6 to vaporizer fuel header 9. Additionally, or alternatively, a supply of natural gas under pressure from natural gas source C flows through line 7 to vaporizer feed header 9 and/or a flow of purge gas or low Btu fuel gas under pressure flows from its source D through line 8 into vaporizer feed header 9. Then the fuel oil in the mixture of fuel oil with diluent from source B, C and/or D, preferably steam, is partially vaporized in vaporizer 10 by heat furnished from a source of heat, such as burner 10a, burning fuel oil through line 14. The combustion gases from vaporizer 10 pass through vaporizer exhaust stack 33 and vaporizer flue gas line 17 to waste heat boiler 30. The heat from burner 10a partially vaporizes the fuel oil in the vaporizer coil 31, then the vaporizer effluent passes through line 11 to separator 15. The heat input to vaporizer 10 is controlled by pressure controller 12 automatically controlling valve 13 in fuel line 14 to burner 10a. The liquid portion of vaporizer effluent from line 11 is separated out in separator 15 and flows through line 4 to be recycled back to vaporizer 10 and also flows through line 29 as blowdown to storage. This blowdown to storage through line 29 removes the accumulated nonvaporized metal and sulfur impurities. The overhead effluent vapor from separator 15 flows through line 16 to superheater 20. Superheater 20 also has a source of heat such as burner 20a fueled by fuel oil through line 19. Burner 20a heats the separator effluent in superheater 20 by heating coils 32. Combustion gases from superheater pass through superheater stack 34 and superheater flue gas line 18 to waste heat boiler 30. The superheated vapor effluent from coil 32 passes through effluent line 21 and on to natural gas burners shown in FIG. 3 through line 21a, the fuel header to the burners. The flow of vaporized fuel oil through line 21 is controlled by vaporized fuel oil valve 27 which is automatically controlled by the flow recorder controller 28. The heat input to the superheater is controlled by temperature controller 22 automatically controlling valve 35 in fuel oil line 19 to burner 20a. The flow of original fuel oil from source A through line 1 is controlled by liquid level controller 23 sensing the liquid level in separator 15 and automatically controlling fuel oil supply valve 24. The flow of steam from source B through line 6 is controlled by ratio flow controller 25 automatically controlling valve 26. Ratio flow controller 25 senses the flow of both the fuel oil and the steam to vaporizer feed header 9. The flow of steam through line 6 is controlled to a set ratio of the flow of fuel oil through line 1.

Figure 2:
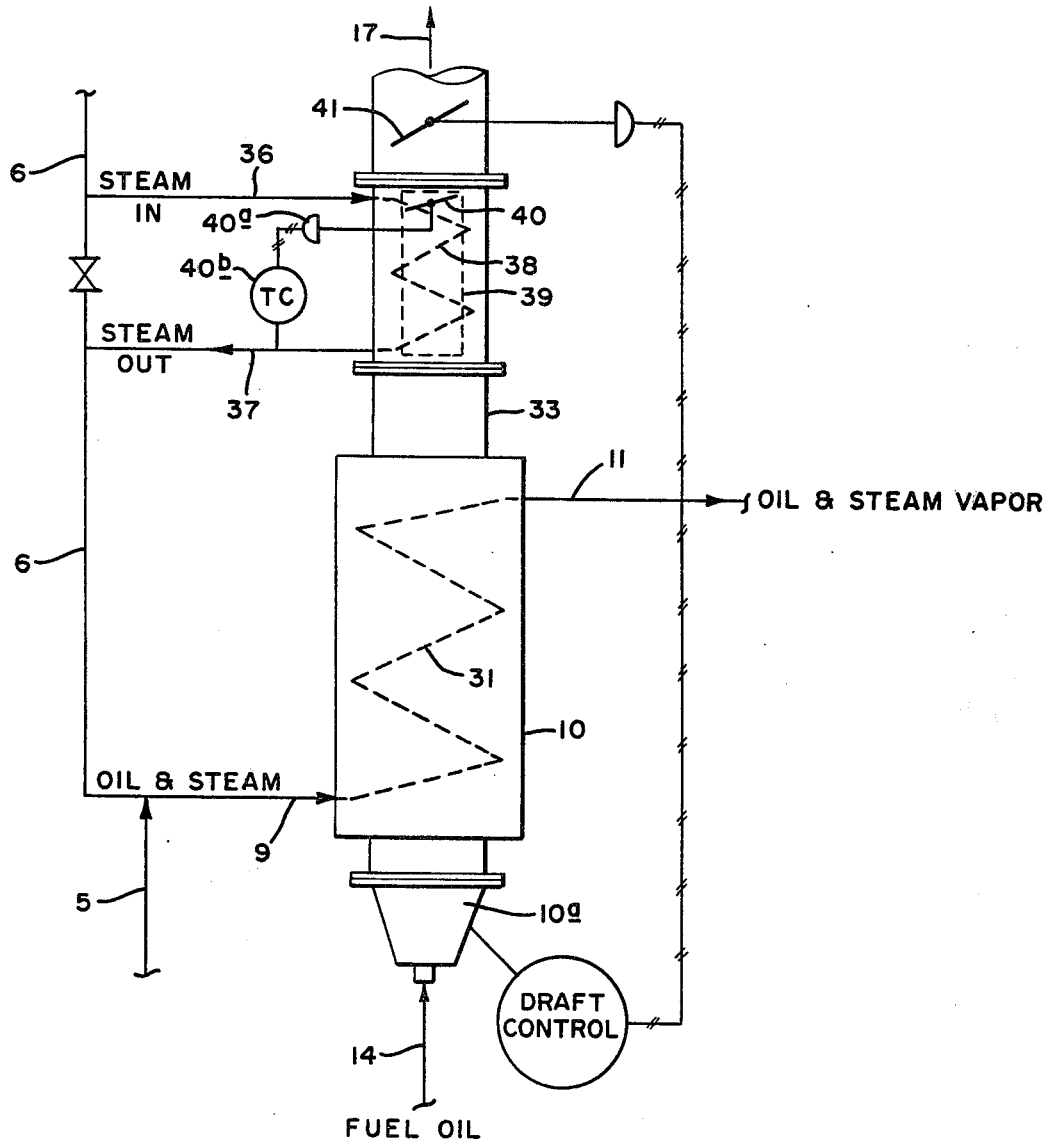
FIG. 2 is a schematic of the vaporizer of this invention, showing the preferred embodiment of the steam superheater in the stack thereof.

In FIG. 2, the preferred embodiment is shown whereby the diluent, such as steam, is preheated. Specifically, steam from line 6 is fed through line 36 to steam superheater coil 38 in stack 33 of vaporizer 10. The superheated steam exits coil 38 through line 37 to return to line 6 which conveys the superheated steam to vaporizer feed header 9 which also receives fuel oil from line 5. Here again, as in FIG. 1, the oil and steam mixture passes through vaporizer 10 through coil 31 and exits through line 11 with the oil partially vaporized. Burner 10a, furnished fuel through fuel oil line 14 makes combustion gases which pass through stack 33 to heat steam superheater coil 38. These combustion gases pass through vaporizer flue gas line 17. Superheater coil 38 surrounds the outer diameter of steam superheater cylinder 39. The flow of combustion gases through stack 33 to heat coil 38 is controlled by steam superheater cylinder damper 40 and vaporizer exhaust damper 41. The amount of hot combustion gases from burner 10a passing over coils 38 can be controlled by opening and closing steam superheater cylinder damper 40. This damper 40 can be controlled by temperature controller 40b on steam superheater line 37 which automatically controls with damper controller 40a. When damper 40 is open more hot gases pass inside cylinder 39 and thus do not heat coil 38. When the temperature of superheated steam in line 37 falls slightly below the control point, the temperature controller 40b calls for damper controller 40a to close damper 40, thus forcing more hot gases outside the cylinder to heat coil 38. Coil 38 could be disposed internally in cylinder 39; in that case the damper would control the opposite way.

Figure 3:
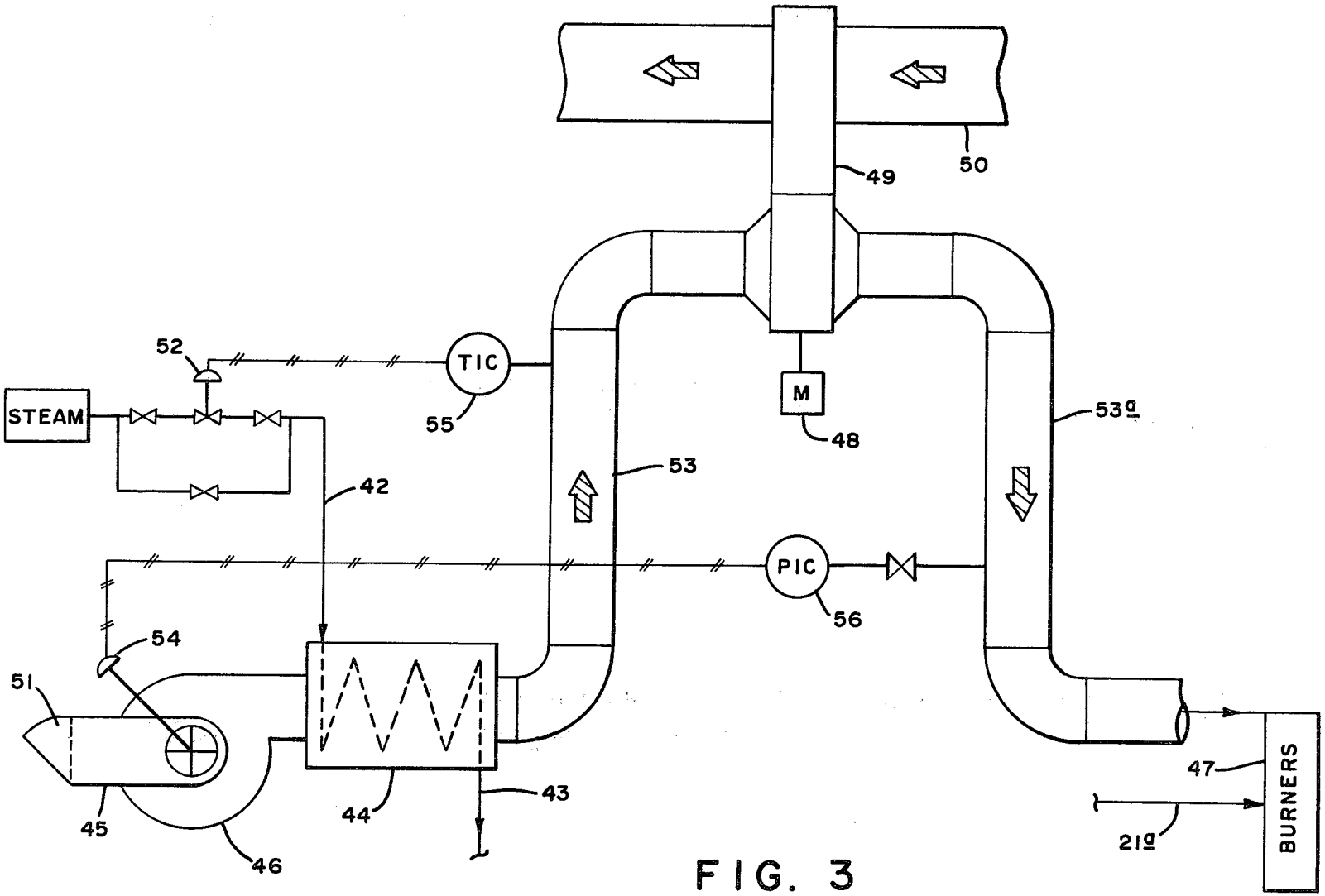
FIG. 3 shows the apparatus and illustrates the method for preheating the combustion air to the burners.

FIG. 3 shows another preferred embodiment of apparatus and method for preheating combustion air to the burners. Burners 47 are fed the heated combustion air through line 53*a* and the vaporized fuel oil with diluent through line 21*a*. Air enters the system through intake screen 51 in air intake line 45. Blower 46 blows air through heat exchanger 44, heated by steam through line 42 and exiting line 43. Temperature of the air in line 53 is controlled by temperature indicator controller 55 which automatically controls valve 52 in steam line 42 which furnishes heat to heat exchanger 44. Also, a major source of heat to heat combustion air is the rotating cylinder type gas to gas exchanger 49 in air line 53. This rotating cylinder type heat exchanger 49, can be the Ljungstrom type manufactured by Air Preheater Company. The source of heat is the hot gases in line 50 which can be hot flue gases from any convenient source. These hot flue gases in line 50 heat the rotating cylinder while it is passing through line 50. The rotating cylinder then rotates into line 53 powered by motor 48 and heats the air in line 53. The heater air then passes through line 53*a* to burner 47. Blower 46 is controlled by pressure indicator controller 56 in heated air line 53*a* which automatically controls blower damper controller 54.

Figure 4:
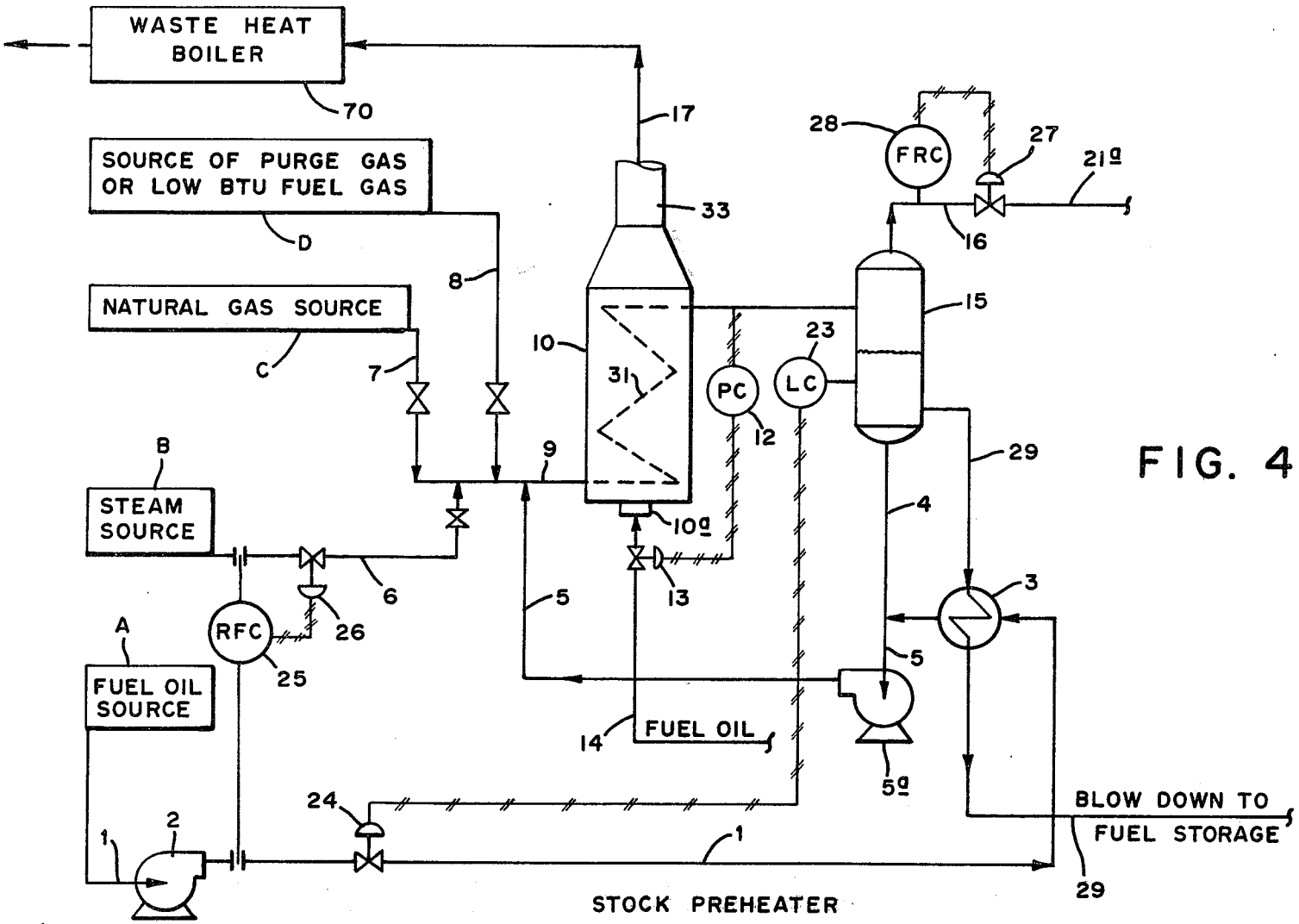
FIG. 4 is a schematic showing the apparatus and illustrating the method of flashing the vapor into the fuel header to the burners without the use of a superheater.

In FIG. 4 the showing of the schematic describing the apparatus and illustrating the method of this invention is the same as in FIG. 1 with like numbers referencing like apparatus. However, in this embodiment the superheater is omitted and the overhead effluent vapor from separator 15 flows through line 16 to be "flashed" across control valve 27 into fuel header line 21*a*. This "flash" embodiment is possible by using higher temperatures and pressures in the vapor system in lines 11, 16 and the overhead of separator 15. The increased heat is supplied by vaporizer 10 and pressure is controlled at a higher level by setting pressure control 12 at a higher level, thereby actuating valve 13 in fuel line 14 to burner 10*a*, until a steady state condition at higher temperature and pressure is achieved.

EXAMPLES

The following examples will further amplify the preferred embodiments of this invention. The runs were accomplished in a radiant wall reformer with a special pilot rig.

In Table A typical flow rates, temperatures, pressures and ratios are given for various operating parameters and conditions. In Table B the run numbers are described by the general mode of parameter being demonstrated.

TABLE A

| | Run Numbers | | | | | | | | | | | | | | | | | | | |
|---|---|---|---|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 | 16 | 17 | 18 | 19 | 20 |
| Number of Burners | 6 | 6 | 6 | 5 | 7 | 6 | 6 | 6 | 6 | 6 | 6 | 6 | 6 | 6 | 6 | 6 | 6 | 6 | 6 | 6 |
| Size of Burner Spud, MTD No. | 30 | 30 | 30 | 30 | 32 | 30 | 30 | 30 | 30 | 30 | 30 | 30 | 30 | 30 | 30 | 30 | 30 | 30 | 30 | 30 |
| Oil Flow to Vaporizer, gpm | .4 | .4 | .44 | .4 | .54 | .38 | .38 | .38 | .32 | .32 | .26 | .27 | .29 | .32 | .27 | .19 | .13 | .26 | .23 | .19 |
| Heat Release, Million | | | | | | | | | | | | | | | | | | | | |
| BTU/hr/burner | .53 | .53 | .53 | .63 | .6 | .5 | .5 | .5 | .42 | .42 | .42 | .42 | .42 | .51 | .43 | .42 | .42 | .42 | .51 | .41 |
| From No. 2 Fuel Oil | .53 | .53 | .33 | .63 | .6 | .5 | .5 | .5 | .42 | .42 | .34 | .35 | .38 | .42 | .36 | .25 | .18 | .34 | .30 | .25 |
| % of Total | 100 | 100 | 100 | 100 | 100 | 100 | 100 | 100 | 100 | 100 | 81 | 84.5 | 90.2 | 83.2 | 82.9 | 59.5 | 42.9 | 81 | 59.9 | 60.9 |
| From Gas | 0 | 0 | 0 | 0 | 0 | 0 | 0 | 0 | 0 | 0 | .08 | .07 | .04 | .09 | .07 | .17 | .24 | .08 | .21 | .16 |
| % of Total | 0 | 0 | 0 | 0 | 0 | 0 | 0 | 0 | 0 | 0 | 19 | 15.5 | 9.8 | 16.8 | 17 | 40.5 | 57.1 | 19 | 40.1 | 39.1 |
| Steam Pressure, psig | 143 | 143 | 146 | 211 | 132 | 141 | 141 | 144 | 145 | 145 | 147 | — | — | — | — | — | — | — | — | — |
| Steam Temperature, ° F. | 720 | 770 | 710 | 745 | 525 | 760 | 920 | 630 | 655 | 680 | 560 | — | — | — | — | — | — | — | — | — |
| Steam to Oil Ratio, lb./lb. | .34 | .34 | .28 | .39 | .43 | .59 | .48 | .38 | .41 | .53 | .3 | — | — | — | — | — | — | — | — | — |
| Temperature at Burner, ° F. | 705 | 734 | 752 | 670 | 734 | 716 | 716 | 704 | 704 | 730 | 730 | 750 | 726 | 688 | 708 | 723 | 728 | 723 | 708 | 704 |
| Pressure at Burner, psig | 42 | 38 | 38 | 42 | 47 | 39 | 31 | 21 | 21 | 26 | 20 | 20 | 15 | 31 | 27 | 18 | 22 | 8 | 21 | 15 |
| TEMPERATURES ° F. | | | | | | | | | | | | | | | | | | | | |
| Inlet Vaporizer | 295 | 295 | 275 | 350 | 315 | 290 | 280 | 260 | 260 | 275 | 220 | — | — | — | — | — | — | — | — | — |
| Outlet Vaporizer | 555 | 540 | 550 | 535 | 580 | 560 | 565 | 510 | 570 | 510 | 500 | 560 | 520 | 520 | 525 | 525 | 570 | 565 | 565 | 565 |
| Inlet Superheater | 480 | 460 | 470 | 410 | 505 | 420 | 420 | 420 | 410 | 425 | 405 | 405 | 405 | 400 | 385 | 390 | 390 | 415 | 385 | 365 |
| Outlet Superheater | 695 | 745 | 740 | 740 | 800 | 820 | 830 | 755 | 810 | 775 | 755 | 750 | 840 | 795 | 705 | 780 | 810 | 835 | 805 | 775 |
| PRESSURES, PSIG | | | | | | | | | | | | | | | | | | | | |
| Steam Header | 154 | 155 | 155 | 221 | 133 | 151 | 151 | 154 | 155 | 152 | 147 | — | — | — | — | — | — | — | — | — |
| Inlet Vaporizer | 72 | 66 | 59 | 185 | 77 | 59 | 52 | 39 | 37 | 42 | 37 | 36 | 26 | 52 | 41 | 30 | 38 | 18 | 33 | 28 |
| Outlet Vaporizer | 56 | 53 | 51 | 172 | 76 | 50 | 42 | 32 | 30 | 36 | 31 | 29 | 20 | 43 | 33 | 23 | 30 | 14 | 27 | 22 |
| Inlet Superheater | 49 | 42 | 40 | 44 | — | 37 | 30 | 21 | 18 | 24 | 22 | 22 | 18 | 30 | 21 | 22 | 23 | — | — | — |
| Outlet Superheater | 42 | 40 | 35 | 38 | 53 | 35 | 29 | 20 | 17 | 24 | 20 | 20 | 15 | 28 | 20 | 22 | 21 | — | 26 | 22 |
| Blowdown, % | 3.5 | 3.5 | 3.5 | 3.5 | 2 | 2–5 | 2–5 | 2–5 | 2–5 | 2–5 | 2–5 | 2–5 | 2–5 | 3.5 | 3.5 | 2–5 | 2–5 | 2–5 | 3.5 | 3.5 |
| Recirculation | Yes | Yes | Yes | Yes | No | No | No | No | No | No | No | No | No | Yes | Yes | No | No | No | Yes | Yes |
| Vaporization, % | <97 | <97 | <97 | <97 | 98 | 95–98 | 95–98 | 95–98 | 95–98 | 95–98 | 95–98 | 95–98 | 95–98 | <97 | <97 | 95–98 | 95–98 | 95–98 | <97 | <97 |
| Flame Characteristics* | G | VG | G | G | G | VG | VG | G | G | VG | G | VG | G | G | G | VG | VG | G | G | G |

*G - Good
VG - Very Good

TABLE B

| Run No. | Description | |
|---|---|---|
| 1 | Typical operation of embodiment of FIG. 1 low steam/oil ratio. | 3.5% blowdown with recirculation |
| 2 | Typical operation of embodiment of FIG. 1 low steam/oil ratio. | |
| 3 | Typical operation of embodiment of FIG. 1 low steam/oil ratio. | |
| 4 | Typical operation of embodiment of FIG. 4 medium steam/oil ratio. | |
| 5 | Typical high percent vaporization, 2% blowdown, no recirculation, medium oil/steam ratio. | |
| 6 | Typical high temperature at superheater and burner, 2-5% blowdown, no recirculation, high steam/oil ratio. | |
| 7 | Typical high temperature at superheater and burner, 2-5% blowdown, no recirculation, high steam/oil ratio. | |
| 8 | Typical medium temperature at superheater and burner, 2-5% blowdown, no recirculation, medium steam/oil ratio. | |
| 9 | Typical high temperature at superheater and burner, low pressure superheater and burner, medium steam/oil ratio. | |
| 10 | Typical medium temperature at superheater and burner, low pressure superheater and burner, high steam/oil ratio. | |
| 11 | Steam and gas and oil operation, 2-5% blowdown, no recirculation. | |
| 12 | No steam, oil and purge gas, 2-5% blowdown, no recirculation, 84% heat from fuel oil. | |
| 13 | No steam, oil and purge gas, 2-5% blowdown, no recirculation, 90% heat from fuel oil. | |
| 14 | No steam, purge gas operation, 2-5% blowdown, no recirculation. | |
| 15 | No steam, purge gas operation, 2-5% blowdown, no recirculation. | |
| 16 | No steam, oil and natural gas, 2-5% blowdown, no recirculation, 60% heat from fuel oil. | |
| 17 | No steam, oil and natural gas, 2-5% blowdown, no recirculation, 43% heat from fuel oil. | |
| 18 | No steam, oil and natural gas, 2-5% blowdown, no recirculation, 81% heat from fuel oil. | |
| 19 | No steam, natural gas operation, 2-5% blowdown, no recirculation. | |
| 20 | No steam, natural gas operation, 2-5% blowdown, no recirculation, and low pressure at superheater and burner. | |

Run numbers 11 to 20 uses a gas as diluent. Run numbers 12 to 20 uses no steam as diluent. Run numbers 11 and 16 to 20 uses natural gas. Run numbers 12 to 15 uses purge gas. All runs are made in a radiant wall reformer heater, with burners originally designed for natural gas. In order to overcome ambient (14° F. and lower) winter temperatures, electric current is passed through the metal of the burner header piping to cause impedance heating, set at 750° F.

The following Tables C to F are runs using the embodiment with a superheater and to demonstrate as noted on the tables. Although at certain times the forced air system formerly used for the gas burner caused insufficient oxygen the runs in general successfully proved the operability of the process. Those runs wherein a bad flame was obtained are omitted, whether for insufficient air or other reasons. These runs were accomplished in a portion of a terraced wall reformer with a special pilot rig.

TABLE C

20% PURGE GAS TESTS

| Test No. | Conditions MM BTU per burner / Special Condition | Gas scfh | Gas lb./hr. | Steam lb./hr. | Oil gpm | Oil lb./hr. | Steam Oil | % Vaporized | Burner psig | Burner ° F | Flame |
|---|---|---|---|---|---|---|---|---|---|---|---|
| 3-11-1 | 2.40/Burner Normal Rate | 3093 | 84.4 | 0 | .49 | 207 | — | 97.6 | 21 | 695 | ok Good 6-7" off wall |
| 3-12-1 | 1.02 Minimum Rate | 1257 | 34.3 | 0 | .21 | 89 | — | 98.0 | 4 | 735 | ok 1" high, clear yellow |
| 3-12-4 | 2.39 | 3093 | 84.4 | 0 | .54 | 228 | — | 88.2 | 19 | 760 | ok 5-6" up, clear yellow |
| 3-25-2 | 1.81 New Burner | 2900 | 79.2 | 0 | .46 | 194 | — | 98.0 est. | 15 | 695 | ok 5-6" yellow and blue |
| 4-1-4 | 2.06 | 2900 | 79.2 | — | .40 | 169 | — | 100.0 | 13 | 710 | Good short blue flame |
| 4-1-5 | 1.98 With steam | 2900 | 79.2 | 37 | .40 | 169 | .22 | 94.3 | 16 | 720 | ok No flashes short blue flame |

TABLE D

10% PURGE GAS TESTS

| Test No. | Conditions MM BTU per Burner / Special Condition | Gas scfh | Gas lb./hr. | Steam lb./hr. | Oil gpm | Oil lb./hr. | Steam/Oil | % Vaporized | Burner psig | Burner ° F | Flame |
|---|---|---|---|---|---|---|---|---|---|---|---|
| 3-11-3 | 2.00 With steam | 1547 | 42.2 | 23 | .55 | 233.0 | .10 | 80.2 | 12 | 725 | ok 3-4" yellow, flickering 8-10" |
| 3-11-6 | 2.03 Moderate with steam | 1835 | 50.1 | 23 | .63 | 267.0 | .09 | 69.5 | 13 | 690 | ok 6-7" yellow |
| 3-11-7 | 2.00 High rate with steam | 1835 | 50.1 | 33 | .63 | 267.0 | .12 | 71.4 | 18 | 720 | ok 6-7" yellow, flickering |
| 3-12-2 | .99 Low Rate | 579 | 15.8 | — | .23 | 97.6 | — | 98.0 est. | 2 | 735 | ok -1", stiff yellow |
| 3-12-3 | .79 Low Rate with Steam | 579 | 15.8 | 28 | .23 | 97.6 | .29 | 98.0 est. | 10 | 760 | ok -1", blue |
| 3-12-8 | 2.25 Normal temperature | 1547 | 42.2 | 27 | .61 | 259.0 | .10 | 82.6 | 18 | 710 | ok 5-6" stiff yellow |
| 3-25-1 | 2.24 | 1451 | 39.6 | 33 | .52 | 221.0 | .15 | 97.0 | 12 | 662 | ok |

TABLE D-continued

10% PURGE GAS TESTS

| Test No. | Conditions MM BTU per Burner / Special Condition | Gas scfh | Gas lb./hr. | Steam lb./hr. | Oil gpm | Oil lb./hr. | Steam/ Oil | % Vaporized | Burner psig | Burner ° F | Flame |
|---|---|---|---|---|---|---|---|---|---|---|---|
| 3-25-4 | Demonstration 2.17 Steam maximum | 1451 | 39.6 | 23 | .52 | 221 | .10 | est. 94.0 est. | 10 | 685 | ok 4–6" blue with yellow top |
| 3-29-1 | 2.07 Check blowdown | 1451 | 39.6 | 33 | .52 | 221 | .14 | 89.0 | 9 | 708 | ok 4–6" yellow, flashes to 10" |
| 3-29-2 | 2.26 Fine 5% blowdown | 1451 | 39.6 | 33 | .52 | 221 | .14 | 98.2 | 10 | 700 | ok 6–7" yellow, much flashing |
| 3-29-3 | 2.12 | 1451 | 39.6 | 33 | .52 | 221 | .14 | 91.4 | 10 | 755 | ok 4–6" yellow |
| 3-29-4 | 2.15 | 1451 | 39.6 | 33 | .52 | 221 | .14 | 92.8 | 10 | 758 | ok 4–6" yellow |
| 3-29-5 | 2.09 | 1451 | 39.6 | 33 | .52 | 221 | .14 | 90.0 est. | 10 | 760 | ok 5–7" yellow |
| 3-29-6 | 2.12 | 1451 | 39.6 | 33 | .52 | 221 | .14 | 91.4 | 10 | 760 | ok 5–7" yellow |
| 3-30-5A | 2.28 Low steam | 1451 | 39.6 | 25 | .52 | 221 | .11 | 99.0 | 14 | 785 | ok 2–3" clear, yellow to white |
| 3-31-1 | 1.99 Turndown | 1256 | 34.3 | 23 | .48 | 204 | .11 | 93.9 | 11 | 740 | ok 4–6" yellow, flashes |
| 3-31-2 | 1.61 | 967 | 26.4 | 29 | .39 | 165 | .18 | 94.3 | 7 | 740 | ok 3–4" yellow, flashes |
| 3-31-3 | 1.06 | 579 | 15.8 | .25 | 106 | .28 | 97.6 | 4 | 720 | ok | 1–2" yellow, flashes |
| 4-1-1 | 2.19 Continuous test | 1451 | 39.6 | 36 | .52 | 221 | .16 | 95.0 | 13 | 705 | ok 3–4 " blue and yellow |
| 4-1-2 | 2.22 | 1451 | 39.6 | 36 | .52 | 221 | .16 | 96.0 | 13 | 720 | ok 3–4" blue with yellow |
| Average of 107 Hour Test: 1.95 MM BTUH/ Burner | | 1547 | 42.2 | 36 | .45 | 191 | .19 | 95.0 | 11 | 713 | |

TABLE E

NATURAL GAS TESTS

| Test No. | Conditions MM BTU per Burner / Special Condition | Gas scfh | Gas lb./hr. | Steam lb./hr. | Oil gpm | Oil lb./hr. | Steam/ Oil | % Vaporized | Burner psig | Burner ° F | Flame |
|---|---|---|---|---|---|---|---|---|---|---|---|
| 3-15-1 | 2.33 MM/Burner 86% NG* Start for Minimum Oil | 3366 | 169 | — | .21 | 89 | — | 96.0 est. | 9 | 720 | ok 4–5", blue, trace of yellow |
| 3-15-2 | 2.44 77.0% NG | 4105 | 206 | — | .15 | 64 | — | 96.0 est. | 10 | 735 | ok 3–4", blue and transparent |
| 3-15-3 | 2.44 77% NG | 4105 | 206 | 28 | .15 | 64 | .44 | 96.0 est. | 14 | 690 | ok 3–4", blue |
| 3-15-4 | 2.31 42% NG | 4689 | 234 | — | .05 | 21 | — | 98.0 est. | 16 | 710 | ok 1–2", blue |
| 3-15-5 | 2.28 53% NG Start for Minimum Gas | 2627 | 132 | — | .28 | 119 | — | 98.0 est. | 8 | 710 | ok 6–7", clear yellow |
| 3-15-6 | 2.24 37% NG | 1806 | 90 | — | .37 | 157 | — | 98.0 est. | 5 | 720 | ok No impingement 6–7", yellow, billowy |
| 3-16-2 | 2.16 55% NG | 2627 | 132 | — | .25 | 106 | — | 98.0 est. | 10 | 710 | ok 5–6", partially clear |
| 3-16-3 | 2.28 53% NG | 2627 | 132 | — | .28 | 119 | — | 98.0 est. | 10 | 680 | ok 7–8", partially clear |
| 3-16-4 | 2.28 53% NG | 2627 | 132 | — | .28 | 119 | — | 98.0 est. | 10 | 660 | ok 7–8", partially clear |
| 3-16-5 | 2.28 53% NG | 2627 | 132 | — | .28 | 119 | — | 98.0 est. | 8 | 635 | ok 7–8", partially clear |
| 3-16-6 | 2.28 53% NG | 2627 | 132 | — | .28 | 119 | — | 98.0 est. | 8 | 670 | No change |
| 3-16-7 | 2.28 53% NG | 2627 | 132 | — | .28 | 119 | — | 98.0 est. | 7 | 610 | ok, slightly more yellow |
| 3-16-8 | 2.28 53% NG | 2627 | 132 | — | .28 | 119 | — | 99.0 est. | 7 | 525 | ok, more yellow |
| 3-17-1 | 1.14 36% NG Low rate, 50% | 903 | 45 | — | .19 | 81 | — | 98.0 est. | 2 | 640 | ok 2–3", yellow |
| 3-17-2 | .80 42% NG Low Rate 40% | 739 | 37 | — | .12 | 51 | — | 98.0 est. | 1 | 640 | ok 1–2", yellow |
| 3-17-3 | 1.68 36% NG 75% Rate | 1313 | 66 | — | .28 | 119 | — | 98.0 | 3 | 675 | ok 3–4", yellow and transparent |
| 3-17-4 | 1.95 36% NG | 1560 | 78 | — | .33 | 140 | — | 96.0 | 4 | 710 | ok 5–6", yellow and |

TABLE E-continued

NATURAL GAS TESTS

| Test No. | Conditions MM BTU per Burner / Special Condition | Gas scfh | Gas lb./hr. | Steam lb./hr. | Oil gpm | Oil lb./hr. | Steam/Oil | % Vaporized | Burner psig | Burner ° F | Flame |
|---|---|---|---|---|---|---|---|---|---|---|---|
| 3-17-7 | 90% Rate 2.69 MM/Burner 72% NG High rate, maximum gas | 4769 | 214 | — | .20 | 85 | — | 95.0 | 10 | 650 | transparent ok 4–5", blue with clear |
| 3-17-8 | 2.73 90% NG High rate, maximum gas | 5918 | 271 | — | .07 | 30 | — | 95.0 | 13 | 640 | ok 4–5%, blue with yellow |
| 3-17-9 | 2.52 33% NG Average steam | 1806 | 90 | 30 | .48 | 204 | .15 | 90.1 | 9 | 660 | ok 5–6", clear with yellow |
| 3-17-10 | 2.57 32% NG More steam | 1806 | 90 | 60 | .48 | 204 | .29 | 92.6 | 11 | 650 | ok 6–7", blue bottom yellow top |
| 3-18-2 | 2.40 11% NG More steam | 575 | 29 | 80 | .61 | 259 | .31 | 88.9 | 9 | 640 | ok 6–7", clear yellow |
| 3-18-3 | 2.33 11% NG Still more steam | 575 | 29 | Z135 | .61 | 259 | .52 | 86.1 | 12 | 660 | ok 2–3", blue with yellow |

*natural gas

TABLE F

100% OIL TESTS

| Test No. | Conditions MM BTU per Burner / Special Condition | Steam lb./hr. | Oil gpm | Oil lb./hr. | Steam/Oil | % Vaporized | burner psig | burner ° F | Flame |
|---|---|---|---|---|---|---|---|---|---|
| 3-17-6 | 2.09 MM/Burner One burner | 53 | .28 | 119 | .45 | 94.9 | 8 | 700 | ok 4–6", blue |
| 3-18-4 | 2.64 Find minimum steam | 185 | .70 | 297 | .62 | 96.1 | 14 | 652 | ok 7–8", blue with yellow |
| 3-18-6 | 2.24 | 120 | .58 | 246 | .79 | 98.5 | 9 | 685 | ok 7–8", clear yellow |
| 3-18-7 | 2.26 | 160 | .58 | 246 | .65 | 99.0 | 12 | 670 | ok 5–6", blue, yellow streaks |
| 3-18-8 | 2.26 | 190 190 | .58 | 246 | .77 | 99.0 | 14 | 655 | ok 3–7", blue, yellow streaks |
| 3-19-1 | 2.20 | 80 | .57 | 242 | .33 | 98.0 | 6 | 670 | ok 5–6", blue, yellow |
| 3-19-3 | 2.17 | 50 | .57 | 242 | .21 | 96.7 | 4 | 675 | ok 4–5", stiff, yellow |
| 3-24-4 | 2.18 One burner (modified) | 52 | .28 | 119 | .44 | 99.0 est. | 14 | 725 | ok 2–3", blue flame |
| 3-24-6 | 2.18 One burner, minimum steam | 49 | .28 | 119 | .41 | 99.0 est. | 13 | 740 | ok 8", yellow with blue |
| 3-24-7 | 2.22 Two burners | 80 | .57 | 242 | .33 | 99.0 est. | 10 | 756 | ok 6–8", yellow with blue |
| 3-25-6 | 2.17 Burner position fix | 67 | .57 | 242 | .28 | 96.6 | 8 | 720 | ok 6–7", yellow, some flickering |
| 3-25-7 | 2.19 More steam | 87 | .57 | 242 | .36 | 97.7 | 11 | 735 | ok 4–6", yellow and blue |
| 3-26-2 | 2.51 Cold air on #3 burner, more steam | 53 | .76 | 322 | .16 | 84.0 | 8 | 705 | #3 ok, 4–6" stiff yellow and blue; #5 out of air, impinging |

We claim:

1. A method to replace natural gas with vaporized fuel oil for burning in at least one natural gas burner without major modifications to said burner, comprising mixing fuel oil with a gaseous diluent, then vaporizing a portion of said fuel oil in said mixture of fuel oil and diluent in a vaporizer, then separating the vapor portion from the liquid portion of said partially vaporized fuel oil as overhead effluent in a separator, said overhead effluent being maintained at about 50° to 300° F. above the dew point of the mixed vapor and diluent, and at about 75 to 150 psig, above the pressure downstream of a valve controlling the flow of said overhead effluent to said burner, while maintaining said overhead effluent at a high temperature and pressure with heat from said vaporizer, and controlling the temperature, pressure and/or flow rates of said mixing, vaporizing and separating, so that said separator overhead effluent mixture of diluted fuel oil vapor flashes to a lower temperature and pressure downstream of said valve controlling the flow of said overhead effluent.

2. The method of claim 1 wherein the temperature is maintained at between about 100°–275° F. above the dewpoint of said mixture, and the pressure is about 100–150 psig, above said downstream pressure.

3. An apparatus to replace natural gas with vaporized fuel oil, whereby fuel oil is mixed with a gaseous diluent and partially vaporized to burn in at least one natural gas burner without major modifications to said burner, comprising an oil vaporizer, a gas-liquid separator, a source of fuel oil under pressure, a source of diluent under pressure, a source of heat for said vaporizer, and a control system to control the temperature, pressure and/or flow rates into and out of said vaporizer and said separator, said fuel oil and diluent being admixed and introduced into said vaporizer, the effluent from said vaporizer being introduced into said separator, and the overhead effluent from said separator being burned in said burner.

* * * * *